US011388518B2

(12) United States Patent
Mikalauskas

(10) Patent No.: US 11,388,518 B2
(45) Date of Patent: Jul. 12, 2022

(54) FLAT PANEL LOUDSPEAKER

(71) Applicant: AMINA TECHNOLOGIES LIMITED, Huntingdon (GB)

(72) Inventor: Egidijus Mikalauskas, Huntingdon (GB)

(73) Assignee: AMINA TECHNOLOGIES LIMITED, Huntingdon (GB)

( * ) Notice: Subject to any disclaimer, the term of this patent is extended or adjusted under 35 U.S.C. 154(b) by 0 days.

(21) Appl. No.: 16/761,759

(22) PCT Filed: Nov. 9, 2018

(86) PCT No.: PCT/GB2018/053246
§ 371 (c)(1),
(2) Date: May 5, 2020

(87) PCT Pub. No.: WO2019/092432
PCT Pub. Date: May 16, 2019

(65) Prior Publication Data

US 2020/0280802 A1 Sep. 3, 2020

(30) Foreign Application Priority Data

Nov. 10, 2017 (GB) ..... 1718621

(51) Int. Cl.
*H04R 7/04* (2006.01)
*H04R 1/02* (2006.01)
*H04R 1/28* (2006.01)

(52) U.S. Cl.
CPC ..... *H04R 7/045* (2013.01); *H04R 1/02* (2013.01); *H04R 1/2811* (2013.01); *H04R 2201/021* (2013.01); *H04R 2440/05* (2013.01)

(58) Field of Classification Search
CPC ..... H04R 7/045; H04R 2440/05; H04R 2440/07; H04R 1/025; H04R 2440/01;
(Continued)

(56) References Cited

U.S. PATENT DOCUMENTS 2,531,634 A * 11/1950 Lawrance ..... H04R 7/10 181/164
3,666,040 A * 5/1972 Junk ..... H04R 1/025 181/150
(Continued)

FOREIGN PATENT DOCUMENTS

CN 1249892 A 4/2000
CN 1319320 A 10/2001
(Continued)

OTHER PUBLICATIONS

International Search Report for Application No. PCT/GB2018/053246 dated Jan. 4, 2019, 6 pages.
(Continued)

*Primary Examiner* — Norman Yu
(74) *Attorney, Agent, or Firm* — Seyfarth Shaw LLP

(57) ABSTRACT

Circular flat panel loudspeaker comprising a resonant with a rear surface opposite the front surface. An exciter is provided at an axial centre of panel and coupled to the rear surface of the panel to cause the panel to vibrate, on operation of the exciter, to generate sound. A frame is provided for mounting in the surface and having the rear surface of the panel fixed thereto around the whole of the outer boundary of the panel, such that when mounted in the mounting surface and when the panel is caused by the exciter to vibrate on operation of the exciter, the outer boundary of the panel is fixed relative to the mounting surface. Means are provided to induce non-circularly symmetric distortion of natural modes of oscillation of the panel, the support frame and the exciter absent the mode distribution means

20 Claims, 5 Drawing Sheets

(58) Field of Classification Search
CPC . H04R 1/02; H04R 9/045; H04R 9/06; H04R 2201/021; H04R 1/2892; H04R 1/00; H04R 1/026; H04R 1/2811
USPC ..... 381/152, 345, 431, 386, 150, 162, 191, 381/395, 398, 423; 181/150
See application file for complete search history.

(56) References Cited

U.S. PATENT DOCUMENTS

| | | | | |
|---|---|---|---|---|
| 6,304,661 | B1 | 10/2001 | Azima et al. | |
| 7,174,024 | B1 * | 2/2007 | Suzuki | H04R 7/04 381/152 |
| 2001/0055402 | A1 | 12/2001 | Azima | |
| 2003/0121718 | A1 | 7/2003 | Stead | |
| 2007/0030985 | A1 * | 2/2007 | Cheung | H04R 7/045 381/152 |
| 2007/0190881 | A1 * | 8/2007 | Shibaoka | H04R 1/06 442/228 |
| 2007/0278033 | A1 | 12/2007 | Bank et al. | |
| 2014/0314268 | A1 * | 10/2014 | Lazzari | H04R 7/04 381/430 |

FOREIGN PATENT DOCUMENTS

| | | | |
|---|---|---|---|
| CN | 2569479 | Y | 8/2003 |
| CN | 102469389 | A | 5/2012 |
| CN | 103269471 | A | 8/2013 |
| CN | 103959822 | A | 7/2014 |
| GB | 2427320 | A | 12/2006 |
| GB | 2544548 | A | 5/2017 |
| GB | 2551723 | A | 1/2018 |
| JP | 4749402 | B2 | 8/2011 |
| WO | 98/39947 | A1 | 9/1998 |
| WO | 01/03467 | A2 | 1/2001 |
| WO | 2013082594 | A1 | 6/2013 |

OTHER PUBLICATIONS

Written Opinion for Application No. PCT/GB2018/053246 dated Jan. 4, 2019, 9 pages.
Combined Search and Examination Report for Application No. GB1718621.4 dated May 10, 2018, 8 pages.
Chinese Office Action for corresponding Chinese Application No. 201880085489.3 dated Jan. 18, 2021, 9 pages.

* cited by examiner

FLAT PANEL LOUDSPEAKER

CROSS REFERENCE TO RELATED APPLICATIONS

This is a National Stage application of, and claims priority to, PCT/GB2018/053246, filed Nov. 9, 2018, which further claims priority to GB Patent Application No. 1718621.4, filed Nov. 10, 2017, the disclosures of which are incorporated herein by reference in their entirety.

This invention relates to a flat panel loudspeaker for mounting in a surface, in particular to a flat panel loudspeaker having a circular resonant panel area.

BACKGROUND

Audio and audio-visual technology has developed significantly in recent years, alongside developing interior design considerations for residential and commercial spaces which may favour minimalistic or cleaner design. Therefore, unobtrusive audio-visual hardware that is commensurate with these design ideals has become increasingly desirable, such as increasingly thin, wall mounted display screens which, due to their reduced profile, have an increasingly limited capacity for providing a quality audio output commensurate with a big screen experience.

Further, the latest audio standards to accompany videos and games can include up to twelve different speakers. The Dolby ATMOS® system uses seven surround sound speakers, a single subwoofer, and four overhead speakers, which leads to a proliferation of acoustic hardware. Furthermore, as the number of speakers to be installed increases, the ease of installation is becoming ever more important.

Discreet speakers provide one such approach to addressing these design and audio needs. One available design of speakers that are discreet are flat panel loudspeakers. On particularly discreet flat panel speaker design is so-called 'invisible' flat panel loudspeakers which are configured for mounting in surfaces, such as the studwork walls of a room, so as to be flush with and effectively invisible in relation to the wall. These 'invisible' speakers are desirable as they avoid the proliferation of hardware and wiring in a room, and are completely discreet. Such an invisible flat panel loudspeaker is described in our previous UK patent application GB2527533. These have typically been provided as premium audio products having a finely-engineered audio design and requiring relatively complicated and specialist installation. This can make the cost of providing such a discreet audio system, particularly to complement a home cinema system for example, relatively high and also the installation requirements relatively complicated so as to render an invisible speaker system to be considered inaccessible to many potential buyers, such as mass market audio consumers who may desire to provide a discreet speaker system in their homes.

It is in this context that the presently disclosed flat panel loudspeaker and associated disclosures have been devised.

BRIEF SUMMARY OF THE DISCLOSURE

In consideration of the context of the above background, the present inventors have realised that providing a flat panel loudspeaker mountable invisibly in a circular opening in a mounting surface would provide an advantageous and accessible means of providing an audio output device addressing the needs of current design ideals and also acoustic limitations and requirements of current audio-visual technology.

Thus, viewed from one aspect, the present disclosure provides a flat panel loudspeaker for mounting in a mounting surface. The flat panel loudspeaker comprises a resonant panel insertable into a circular opening in the mounting surface and having a front surface having an outer boundary formed to be substantially circular, the front surface to face outwardly in the mounting surface when the flat panel loudspeaker is mounted in the mounting surface, and the resonant panel further having a rear surface opposite the front surface; an exciter located substantially at an axial centre of the circular resonant panel and coupled to the rear surface of the resonant panel to cause the resonant panel to vibrate, on operation of the exciter, to generate sound; a support frame for mounting in the mounting surface and having the rear surface of the resonant panel fixed thereto around substantially the whole of the outer boundary of the resonant panel, such that when mounted in the mounting surface and when the resonant panel is caused by the exciter to vibrate on operation of the exciter, the outer boundary of the resonant panel is fixed relative to the mounting surface; and mode distribution means configured to induce, in use, non-circularly symmetric distortion of natural modes of oscillation of the resonant panel in response to operation of the exciter in an assembly of the resonant panel, the support frame and the exciter absent the mode distribution means.

In the 'invisibly mounted' flat panel speakers of the presently disclosed design, similar to those acknowledged in the background above, a flat resonant panel is mounted to a support frame through which the flat panel speaker is coupled to a structure, such as a surrounding rear surface of a wall or studwork, such that the flat resonant panel is substantially flush with the surface. By forming an opening in the wall having inner dimensions such that the resonant panel fills the opening in the surface once mounted, the flat panel speaker can be 'invisible' or effectively merged with or forming part of the surface itself, particularly when any gaps between the panel and surrounding surface are covered, and/or the panel and surrounding surface are together covered, for example, by a thin plaster skim.

For the speaker mounted to be flush with a surface to remain 'invisible' in the surface, it is important that there is no discontinuity between the surface, e.g. of the wall, and the flat panel even when the flat panel is excited to vibrate and create sound, because the covering at the joint between the panel and the surrounding surface, for example a plaster skim, would not be sufficiently flexible to withstand the localised relative movement, and so would crack, giving an undesirable effect on the finish of the surface.

However, in the flat panel speaker of the present design, the resonant panel is fixed or bonded to the, normally relatively rigid, support frame supporting the panel from behind around its outer boundary. In this way, when the flat panel speaker is fixedly mounted in the surface in use (such as through the support frame) the bonded edges of the resonant panel are substantially immovable relative to the support frame and thereby also relative to the mounting surface in use. As a result, even when the resonant panel is excited to vibrate by the exciter, there are no discontinuities between the surface of the flat panel at the edge and the surrounding wall. This means that flat panel loudspeakers can be mounted flush with a mounting surface and seamlessly covered at the join between the panel and the mounting surface, such that they can appear substantially invisible in the mounting surface, in use.

As a result of the panel being fixed relative to the support frame, acoustic wave generation by the panel is achieved not through pistonic motion of the panel as a whole (as in the case of a diaphragm or cone of a traditional dynamic loudspeaker). Rather, acoustic waves are created by the exciter (which may be a moving coil exciter or another appropriate electrical signal-motion transducer) exciting the panel material to be deflected away from its at-rest position to vibrate in vibrational modes along its length between its fixed outer boundary. In this regime, the vibrational modes in which the panel more naturally resonates—the resonant modes—and in which the electrical signal driving the exciter can more easily transfer a greater amount of energy, are dependent on the distance from the excitation point to the constrained edge of the speaker. Further, the resonant modes are also dependent on other factors that act against the deformation of the panel material (such as the relatively rigid circular foot coupling the exciter voice coil to the panel) into an acoustic signal. The amount of energy transferable into the different vibrational modes of the speaker governs the transfer function of the flat panel speaker—i.e. its frequency response.

In order to transfer sufficient vibrational energy into a range of frequencies spread across the low-range frequencies (LF), mid-range frequencies (MF) and high frequencies (HF) to produce a good quality audio response, previous 'invisible' flat panel loudspeakers of this design have used a rectangular resonant panel, with one or more exciters being located at specific positions to produce an acoustically-designed response. The rectangular resonant panel ensures that the distance from the exciter to the boundary of the resonant panel is not the same all the way around the panel so that panel has a range of paths along the surface into which the panel can be excited to produce different resonant frequencies. A variation in the distance from the exciter to the boundary of the resonant panel helps to ensure that the frequency response for the flat panel loudspeaker is substantially smoothed. In other words, the frequency response for the flat panel loudspeaker does not exhibit as many or as pronounced disadvantageous notches or peaks or dips in the frequency response, particularly in the low frequency region and the mid frequency region.

In contrast, the present inventors have realised that where a circular resonant panel is used, as in the presently disclosed flat panel speaker design, due to the circular geometry of the resonant panel, such a range of frequency responses is not naturally available. In particular, in order to produce loud audio, an exciter of the flat panel loudspeakers is mounted substantially centrally on the resonant panel, so that the exciter is spaced as far as possible from the fixed boundary of the resonant panel on all sides, allowing for the maximum vibration of the resonant panel, causing efficient sound production. As a result, with a centrally mounted exciter in a circular resonant panel fixed at its edges, there is no natural variation in the distances from the exciter location to the fixed edge of the panel around the panel, and as a result, the natural frequency response of the panel features resonant peaks and dips, particularly in the LF range, and generally significantly more energy is transferred into the mid-range frequencies than low range frequencies, producing a sound response that some users may perceive to be 'tinny'.

Despite the above, the present inventors have realised that a discreet and easily mountable speaker can be provided having a desirably good audio response by a circular flat panel speaker in which the resonant panel is bounded to a support frame around its outer boundary so as to be invisibly mountable in a surface, in which the panel is excited by a substantially centrally-positioned exciter, in which mode distribution means are provided, configured to induce, in use, non-circularly symmetric distortion of natural modes of oscillation of the resonant panel in response to operation of the exciter in an assembly of the resonant panel, the support frame and the exciter absent the mode distribution means. By the mode distribution means inducing non-circularly symmetric distortion of natural modes of oscillation of the resonant panel, the natural frequency response of the circular flat panel speaker is adjusted to smooth out the resonant peaks and troughs, and to balance the frequency spectrum, in particular the LF and mid-range, to produce a desirable and perceptibly 'good' audio response.

The effect of the mode distribution means on the frequency response of the circular flat panel speaker can be seen in particular in FIG. 1, which shows a simulated frequency response for a circular flat panel loudspeaker as described above, both with and without the mode distribution means. The line having data points represented by triangles shows the frequency response of the flat panel loudspeaker as described, in the absence of the mode distribution means. As can be seen, the frequency response exhibits several pronounced peaks and notches, in particular at low and mid frequencies (i.e. below 10 kHz), though there also continue to be peaks and notches in the high frequency region of the frequency response. Further, the reproducible sound intensity in the mid-range frequencies (generally around 200-2000 Hz) can be seen to be relatively high, whereas the low frequency range (below around 200 Hz) is relatively weakly reproduced. The line having data points represented by circles shows the frequency response of the flat panel loudspeaker as described, including the mode distribution means. As can be seen, the frequency response is far smoother when compared with that shown by the solid line. The height of the peaks and the depth of the notches have both been reduced to substantially flatten the frequency response, leading to an increase in the audio quality produced by the flat panel loudspeaker, particularly at low and mid frequencies. Further, it can be seen that the low range frequency response has been boosted by shifting some energy from the mid-ranges in particular.

This redistribution and smoothing of the reproducible frequencies is achieved by the mode distribution means inducing non-circularly symmetric distortion of natural modes of oscillation of the resonant panel. As can be seen in FIGS. 2A and 2B, which are schematic representations illustrating the displacement at resonant modes in the resonant panel in the absence of the mode distribution means. FIG. 2A shows the first resonant mode and FIG. 2B shows the second resonant mode in which the fixed edges of the panel and the fixing of the rear of the panel to relatively rigid cylindrical foot of the exciter represent boundary conditions. As can be seen from FIGS. 2A and 2B, the intensity of displacement in these natural resonant modes from excitation of the panel is significant, meaning that a large amount of energy is coupled into them.

On the other hand, FIGS. 2C and 2D are schematic representations illustrating the displacement at resonant modes in the resonant panel with the mode distribution means added to the panel assembly. FIG. 2C shows the first resonant mode and FIG. 2D shows the second resonant mode. Thus, it can be seen that the intensity of the displacement in the resonant modes is greatly reduced, meaning that the excess energy is coupled into other modes of vibration, thereby enabling vibrational energy to be coupled into the generation of a broader range of different frequencies. It will also be appreciated that the displacement from the first and second resonant modes of the resonant panel (with the mode distribution means) is achieved by a non-circularly symmetric distortion applied by the mode distribution means to the resonant panel. Indeed, the displacement from the modes of resonance of the resonant panel (with the mode distribution means) is not even rotationally symmetric on the resonant panel. This mode distribution means enables the smoothing and improvement of the audio response of the circular flat panel speaker. The present inventors have included mode distribution means in a flat panel loudspeaker having a circular resonant panel, which results in a flat panel 'invisibly mountable' loudspeaker, which is easy to install, and which also gives a perceptibly 'good' audio response.

As noted above, although circular cones are used in conventional pistonic cone loudspeakers to generate sound via pistonic motion of the cone, this is a completely different speaker technology. This is because the edge of the cone in a pistonic cone loudspeaker is arranged to move pistonically. In contrast, the edge of the resonant panel in the flat panel loudspeaker is physically constrained such that it is substantially fixed relative to the surface in which the flat panel loudspeaker is mounted. One effect of this constrained edge is that there exists a restoring force which acts to restore the resonant panel to a flat equilibrium whenever the exciter causes a displacement of the central region of the resonant panel. The presence of the restoring force helps to ensure that any slight unbalancing of the resonant panel caused by the mode distribution means does not affect the ability of the resonant panel to generate sound. This is unlike in a pistonic cone loudspeaker in which a distortion of the pistonic motion of the speaker cone would be detrimental to the sound generated and could also damage the speaker.

Thus, there is provided a flat panel loudspeaker with good acoustic performance which can be easily mounted within a surface. The circular form of the resonant panel can be easily accommodated in a circular opening in the mounting surface, which is straightforward to create using, for example, a tank cutter or a hole saw and a conventional drill. Furthermore, ease of assembly and efficient acoustic operation of the flat panel loudspeaker is achieved by mounting the exciter axially centrally on the rear surface of the resonant panel. In this way, the distance from the exciter to the boundary of the resonant panel is substantially the same all the way around the exciter. Further, when the exciter is mounted axially centrally on the rear surface of the resonant panel, an axial angle of the exciter relative to the rear surface of the resonant panel remains substantially unchanged during operation of the exciter (which would not be true were the exciter to be mounted away from the centre of the resonant panel). Yet further, good acoustic performance of the flat panel loudspeaker is ensured by providing mode distribution means, which counter the otherwise negative effects of mounting the exciter substantially at an axial centre of the circular resonant panel. Thus, in combination, the disclosed flat panel loudspeaker is easy to install and manufacture, whilst also providing good sound quality.

Generally, circularly formed components, such as the support frame and panel material in the flat panel speaker of the presently disclosed design, are relatively difficult and expensive to manufacture, compared to rectangular or square components, particularly where small batches are concerned, as expensive tooling needs to be designed, made and used to manufacture the parts.

This generally has not mattered previously, as these 'invisibly mountable' flat panel loudspeakers have been of a rectangular design, and so the parts have been more easily manufactured from bulk materials, e.g. by machining and stamping. As these products have generally only been hand finished in relatively small batches and not mass manufactured, the production techniques have been scalable to the market demand.

However, the present inventors have realised that, as the circular 'invisible' flat panel speakers of the present design are easier to install, the demand for these products is potentially significant. Thus, the circular 'invisible' flat panel speakers of the present design will be needed in larger quantities. As such, the previous undesirability of the circular components, due to the initial development of the relatively complicated and expensive tooling needed to manufacture the parts, can be overcome.

It has been found that without the mode distribution means, the substantially uniform distance from the exciter to the boundary of the circular resonant panel would lead to poor sound quality, for example due to acoustic artefacts in the frequency response for the flat panel loudspeaker (in particular at low and mid frequencies). Such artefacts are typically due to a restriction in the movement of different regions of the resonant panel imposed by the presence of the exciter. In some cases, the disadvantageous artefacts would be in the form of one or more notches and/or peaks in the low and mid frequency regions of the frequency response of the assembly of the resonant panel, the support frame and the exciter absent the mode distribution means. By including the mode distribution means, acoustic energy from other areas of the frequency response can be redistributed to the frequency corresponding to the notches and/or peaks. In this way, the frequency response at the frequencies corresponding to be notches can be increased and the frequency response at the frequencies corresponding to the peaks can be decreased, resulting in a more uniform frequency response, as seen in FIG. 1.

The mode distribution means may be configured to induce, in use, non-rotationally symmetric distortion of natural modes of oscillation of the resonant panel in response to operation of the exciter in the assembly of the resonant panel, the support frame and the exciter absent the mode distribution means. It will be understood that the term "non-rotationally symmetric" will be understood to mean that there is no rotational symmetry in the distortion of the natural modes of oscillation of the resonant panel. In other words, the distortion in the natural modes of oscillation of the resonant panel on the plane of the front surface of the resonant panel is not repeated at any other rotational angle of the resonant panel. Thus, the acoustic energy in the frequency response of the resonant panel can be particularly effectively distributed to the notches in the frequency response (and away from the peaks in the frequency response). The mode distribution means may comprise one or more components coupled to the resonant panel to add weight thereto to induce the distortion in the natural modes of resonant oscillation of the resonant panel in the assembly of the resonant panel, the support frame and the exciter in response to operation of the exciter.

The one or more components may be formed from non-toxic metal.

The one or more components may be formed from a non-ferrous material, for example a substantially non-ferrous metal such as stainless steel. Thus, when the exciter is a magnet-based exciter, such as a moving coil exciter, then the proximity of the one or more components to the exciter will not interfere in the operation of the exciter. The one or more components may be coupled to the resonant panel substantially just outside the exciter. Advantageously, this maximises the effect of the mass of the one or more components. In other words, greater masses would need to be used to achieve a similar affect if the masses needed to be positioned further from the centre of the resonant panel, increasing at least the overall weight and material cost of the flat panel loudspeaker.

The one or more components may be coupled to the resonant panel away from the centre of the resonant panel in a direction along the rear surface of the resonant panel.

The one or more components may be at least two components. Each component may be differently spaced from the centre of the resonant panel. Thus, the combination of the resonant panel and the at least two components does not have a line of symmetry dividing a first region comprising one of the at least two components and a second region comprising another of the at least two components.

The at least two components may each have a different mass. The at least two components may each be formed to have a different shape.

The at least two components may be spaced apart over a region of at least 60 degrees relative to the centre of the resonant panel.

The at least two components may be at least four components. A maximum angular spacing between any two components, relative to the centre of the resonant panel, may be less than 180 degrees. Thus, the components may be spaced around substantially the whole of the resonant panel.

A maximum angular spacing between any two components, relative to the centre of the resonant panel, may be less than 150 degrees. A maximum angular spacing between any two components, relative to the centre of the resonant panel, may be less than 130 degrees. A maximum angular spacing between any two components, relative to the centre of the resonant panel, may be less than 110 degrees. A maximum angular spacing between any two components, relative to the centre of the resonant panel, may be less than 100 degrees.

The one or more components may be coupled to the rear surface of the resonant panel. Thus, in use, the one or more components are not visible by a user, who may see the front surface of the resonant panel, facing outwardly into a room bordered by the surface in which the flat panel loudspeaker is mounted.

The mode distribution means may be provided in the form of depressions defined in the front surface of the resonant panel and configured to be selectively filled in during mounting of the flat panel loudspeaker in the mounting surface to induce the distortion in the natural modes of resonant oscillation of the resonant panel in an assembly of the resonant panel, the support frame and the exciter, in the absence of the mode distribution means, in response to operation of the exciter.

A centre of mass of an assembly of the resonant panel and the mode distribution means may be away from a centre of the resonant panel in a direction along the front surface of the resonant panel.

The exciter may be coupled to the rear surface of the resonant panel via a foot. The mode distribution means may be provided at one or more regions of the resonant panel outside the foot. The use of the foot ensures that energy from the exciter will be transferred efficiently to the resonant panel.

The mode distribution means may be arranged, in use, to be asymmetric relative to any line of symmetry through the centre of the resonant panel.

The resonant panel may have an outer diameter of less than 30 centimetres. Thus, the flat panel loudspeaker can be manufactured relatively inexpensively compared to flat panel loudspeakers having a resonant panel with a larger surface area. Furthermore, the opening in the mounting surface can be easily formed using a hole saw.

The resonant panel may be formed to have a substantially constant density per unit area across the front surface of the resonant panel. In some embodiments, the resonant panel may be formed to have a density per unit volume which is different in different regions of the resonant panel.

A maximum thickness of the resonant panel may be less than 3 millimetres. In some examples, the maximum thickness of the resonant panel may be approximately 2 millimetres.

A stiffness of the resonant panel may be sufficient to cause sound having a high frequency over 10 kHz to be emitted from the resonant panel when the exciter is operated at substantially the high frequency. Thus, the resonant panel is formed such that it is suitable for use to reproduce high frequency sounds.

A stiffness of the resonant panel is sufficiently low to cause sound having a low frequency below 100 Hz to be emitted from the resonant panel when the exciter is operated at substantially the low frequency. Thus, the resonant panel is formed such that it is suitable for use to reproduce low frequency sounds.

In an example, the resonant panel is formed to have a predetermined stiffness such that it is suitable for use to reproduce both sounds having a frequency greater than 10 kHz and sounds having a frequency lower than 100 Hz.

The resonant panel may comprise an inner region and a boundary region surrounding the inner region and extending to the outer boundary of the resonant panel. The front surface of the resonant panel in the boundary region may be defined by a depression relative to at least a portion of the front surface of the resonant panel in the inner region. Thus, when the flat panel loudspeaker is mounted in the mounting surface, a surface covering can extend over the boundary region but not over the inner region, whereby the inner regions is mounted to be substantially flush with the mounting surface when covered with the surface covering. The surface covering may be, for example, plaster. The front surface of the resonant panel in the boundary region may be depressed from the at least a portion of the front surface of the resonant panel in the inner region by between 0.5 millimetres and 1 millimetre.

The resonant panel may be a pressed panel. Thus, the resonant panel may be formed by pressing. In examples, the resonant panel may be formed by: pressing a resonant panel blank between a first pressing surface and a second pressing surface of a press, wherein the second pressing surface substantially opposes the first pressing surface; and curing the resonant panel blank between the first and second pressing surfaces to form the resonant panel of the flat panel loudspeaker. The resonant panel blank may comprise: a skin having an outer surface in contact with the first pressing surface; and at least one layer of a pre-preg material provided on an inner surface of the skin, the inner surface being opposite the outer surface. The present inventors have found that forming a resonant panel by pressing (instead of for example, machining) provides a resonant panel with the right mechanical properties, such as stiffness, to provide exemplary audio quality in a flat panel loudspeaker having a circular resonant panel.

Thus, the resonant panel formed by pressing may have a stiffened skin, resulting in a stiffened resonant panel. Where the resonant panel is formed from two skin layers separated by a pre-preg layer, both skin layers may be stiffened such that the resonant panel forms a substantially I-beam structure particularly suitable for reproducing high frequency sounds when excited in the flat panel loudspeaker as described hereinbefore.

The pre-preg material may be a resin comprising woven fibres, for example phenolic coated glass woven resin. Thus, the stiffness of the resonant panel can be such that the panel can be used to reproduce sounds having a high frequency greater than 10 kHz and sounds having a low frequency less than 100 Hz.

The skin may be formed from fibreboard, for example, paper.

The present inventors have found that a high pressing force in the press causes the pre-preg material to at least partially extend within the skin layer, whereby to create a particularly stiff skin for the resulting resonant panel.

The resonant panel in some examples may be integrally formed. The resonant panel may extend substantially homogenously to the outer boundary of the resonant panel. In other words, the resonant panel is substantially stiff enough to be deflected on operation of the exciter to produce audio output across the whole of the region of the resonant panel within the outer boundary of the resonant panel.

The support frame may comprise a mounting component for mounting the flat panel loudspeaker in the mounting surface. The mounting component may be in the form of a screw boss, and/or adhesive and may be arranged to attachment of the support frame to a rear side of the mounting surface.

The rear surface of the resonant panel may be secured to the support frame by adhesive. Alternatively or additionally, the rear surface of the resonant panel may be secured to the support frame by mechanical fastening means, such as screws.

The exciter may be further mounted to the support frame. Thus, operation of the exciter may directly move the inner region of the resonant panel relative to the support frame.

The support frame may be formed from a plastics material.

Viewed from another aspect, there is also provided a method of mounting a flat panel loudspeaker in a mounting surface. The flat panel loudspeaker comprises: a resonant panel insertable into a circular opening in the mounting surface and having a front surface having an outer boundary formed to be substantially circular, the front surface to face outwardly in the mounting surface when the flat panel loudspeaker is mounted in the mounting surface, and the resonant panel further having a rear surface opposite the front surface; an exciter located substantially at an axial centre of the circular resonant panel and coupled to the rear surface of the resonant panel to cause the resonant panel to vibrate, on operation of the exciter, to generate sound; a support frame for mounting in the mounting surface and having the rear surface of the resonant panel fixed thereto around substantially the whole of the outer boundary of the resonant panel, such that when mounted in the mounting surface and when the resonant panel is caused by the exciter to vibrate on operation of the exciter, the outer boundary of the resonant panel is fixed relative to the mounting surface; and mode distribution means configured to induce, in use, non-circularly symmetric distortion of natural modes of oscillation of the resonant panel in response to operation of the exciter in an assembly of the resonant panel, the support frame and the exciter absent the mode distribution means. The method comprises: forming a circular opening in the mounting surface having a diameter greater than a diameter of the outer boundary of the resonant panel; inserting the flat panel loudspeaker in the circular opening; and securing the support frame at the mounting surface such that the front surface of the resonant panel faces outwardly in the mounting surface and is provided substantially flush to the mounting surface.

Thus, the flat panel loudspeaker described previously may be easily mounted into a mounting surface.

The circular opening may be formed using a hole saw. Thus, the circular opening may be easily and accurately formed using a widely available tool.

The flat panel loudspeaker may be held in position in the mounting surface during mounting using a strap temporarily attached to the flat panel loudspeaker and extending past an outer boundary of the resonant panel, or any other support component.

The method may further comprise applying a covering to the mounting surface after the support frame is secured at the mounting surface. The covering may extend over at least an interface between the mounting surface and the resonant panel.

Thus, the edges of the flat panel loudspeaker can be easily concealed by a covering applied over an edge of the flat panel loudspeaker and over the boundary region of the resonant panel.

In some examples, the covering may extend over substantially the whole of the resonant panel such that the whole of the resonant panel is hidden behind the covering in use.

The covering may be plaster.

The flat panel loudspeaker may be as described hereinbefore.

BRIEF DESCRIPTION OF THE DRAWINGS

Embodiments of the invention are further described hereinafter with reference to the accompanying drawings, in which.

DETAILED DESCRIPTION

The present disclosure describes a flat panel loudspeaker which is easy to install and suitable for mass-market use.

Figure 1:
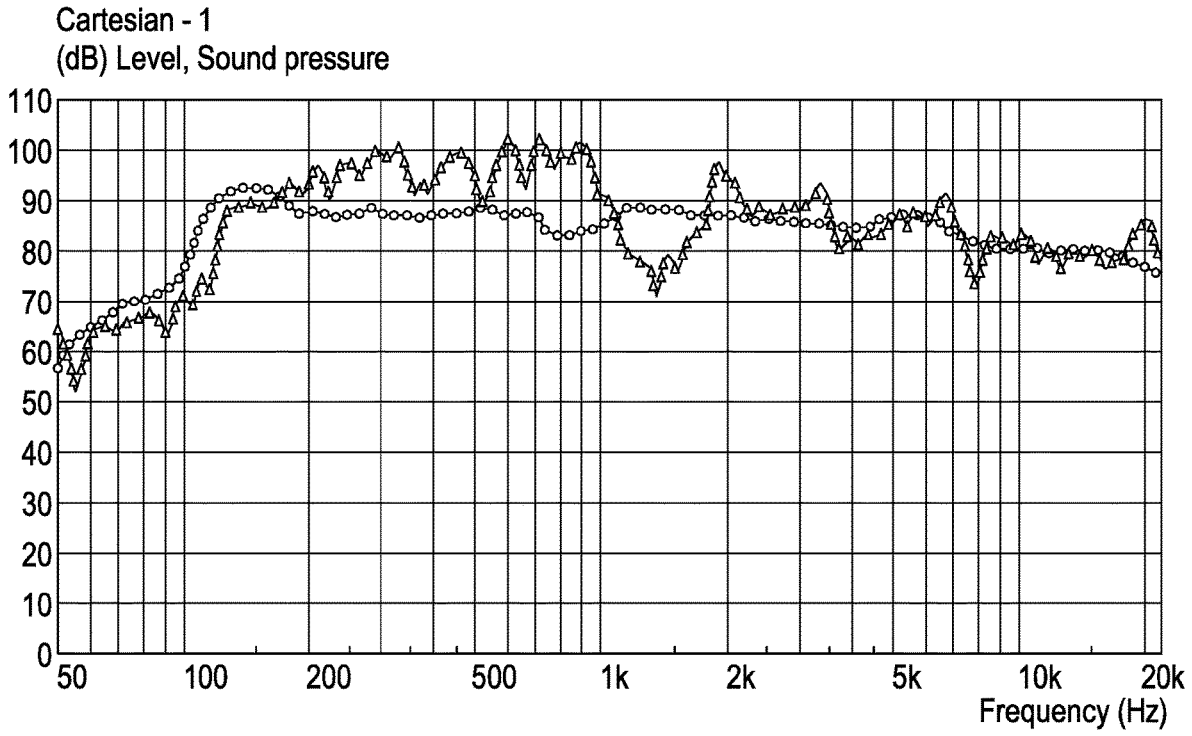
FIG. 1 shows a simulated frequency response for a resonant panel of a circular flat panel loudspeaker, with and without a mode distribution means.
Figure 2A:
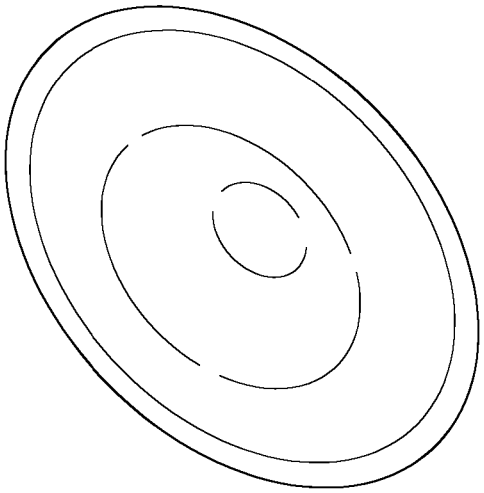
FIGS. 2A to 2D are schematic representations illustrating the displacement at two different resonant modes for each of two different resonant panels.
Figure 2B:
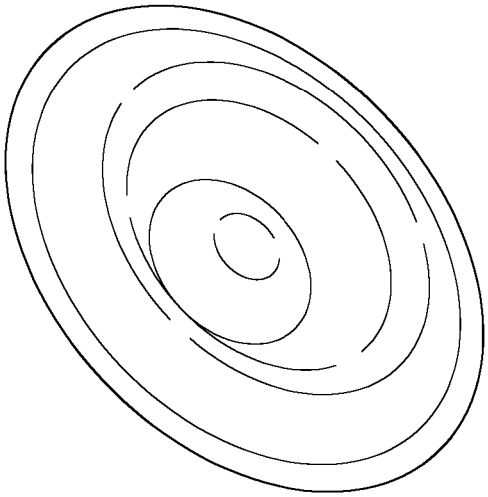
Figure 2C:
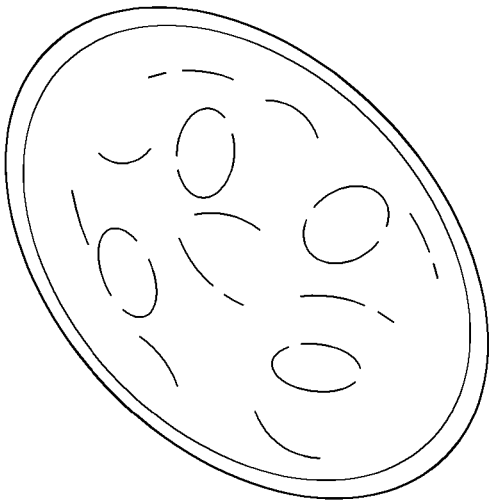
Figure 2D:
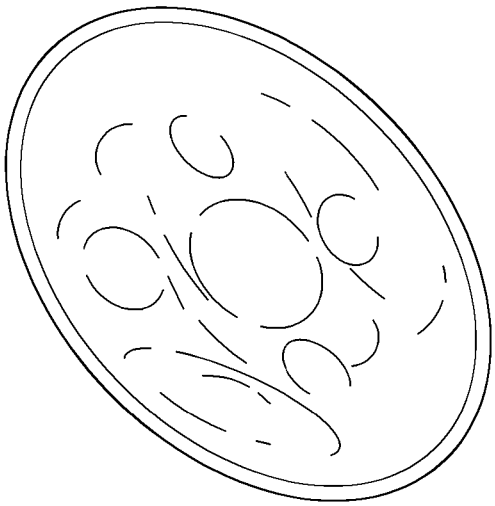
Figure 3:
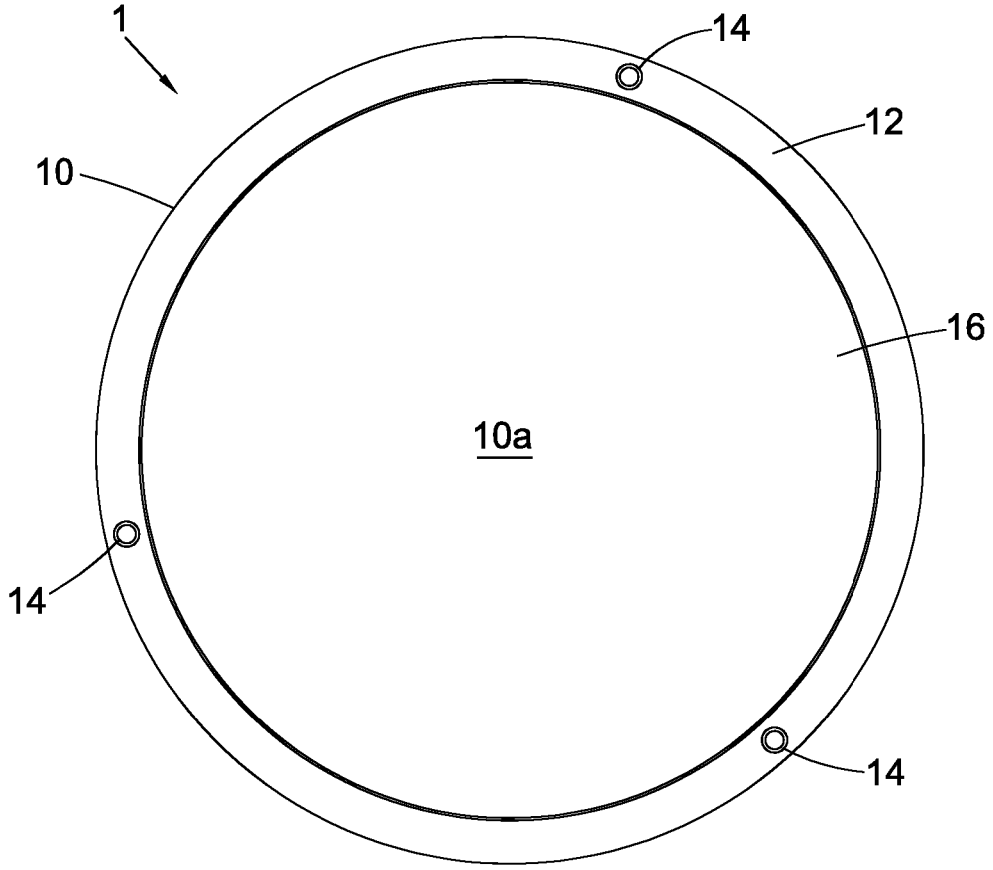
FIG. 3 is an illustration of a circular flat panel loudspeaker.

FIG. 3 is an illustration of a circular flat panel loudspeaker. The flat panel loudspeaker 1 is for mounting in a mounting surface (not shown) and comprises a resonant panel 10, an exciter 30 (see FIG. 4) to cause the resonant panel to vibrate to generate sound on operation of the exciter, a support frame 20 (see FIG. 4) and mode distribution means 50 (see FIG. 6) to induce non-circularly symmetric distortion of natural modes of oscillation of the resonant panel 10 in response to operation of the exciter 30 in an assembly of the resonant panel 10, the support frame 20 and the exciter 30, absent the mode distribution means 50.

The resonant panel 10 is insertable into a circular opening in the mounting surface. Thus, in this example, the resonant panel 10 is formed to be substantially circular. The resonant panel has a front surface 10*a* and a rear surface 10*b* (see FIG. 6) opposite the front surface 10*a*. The front surface 10*a* has an outer boundary formed to be substantially circular. The front surface 10*a* is arranged to face outwardly in the mounting surface when the flat panel loudspeaker 1 is mounted in the mounting surface. In this example, an outer boundary region 12 of the resonant panel has defined therein a plurality of mounting points in the form of mounting holes 14. An inner region 16 of the resonant panel 10 is defined within the outer boundary region 12

Figure 4:
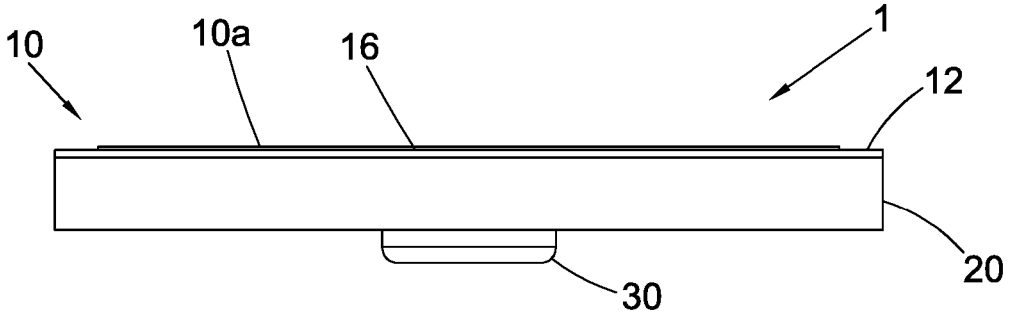
FIG. 4 is a further illustration of the flat panel loudspeaker of FIG. 3.

FIG. 4 is a further illustration of the flat panel loudspeaker of FIG. 3. As can be seen, the flat panel loudspeaker 1 further comprises a support frame 20 and an exciter 30. The resonant panel 10 is mounted to the support frame 20. In particular, the rear surface 10*b* of the resonant panel 10, opposite the front surface 10*a* of the resonant panel 10 is mounted to the support frame 20 around substantially the whole of the outer boundary of the resonant panel 10. In other words, the resonant panel 10 is mounted to the support frame 20 in the outer boundary region 12. The support frame 20 is configured to be mounted in the mounting surface in use, such that the front surface 10*a* of the resonant panel 10 is arranged to be mounted substantially flush with the mounting surface. The exciter 30 is located substantially at an axial centre of the circular resonant panel 10. The exact configuration of the exciter will be explained further with reference to FIG. 5 below.

As can be seen in FIG. 4, in this example, the inner region 16 of the resonant panel 10 is formed to protrude outwardly from the outer boundary region 12 of the resonant panel 10. Thus, when the flat panel loudspeaker 1 is to be mounted in the mounting surface, a surface finish, such as plaster, can be applied to the mounting surface and extend over the outer boundary region 12 of the resonant panel 10. The difference in relief between the outer boundary region 12 and the inner region 16 is substantially identical to the thickness of the surface finish to be applied. Thus, the inner region 16 may be substantially flush with the mounting surface when the flat panel loudspeaker 1 is installed in the mounting surface. In this example, the surface finish of at least the inner region 16 of the resonant panel 10 may be predetermined to be substantially similar to a surface finish to be finally applied to the mounting surface when the flat panel loudspeaker 1 is mounted in the mounting surface.

Figure 5:
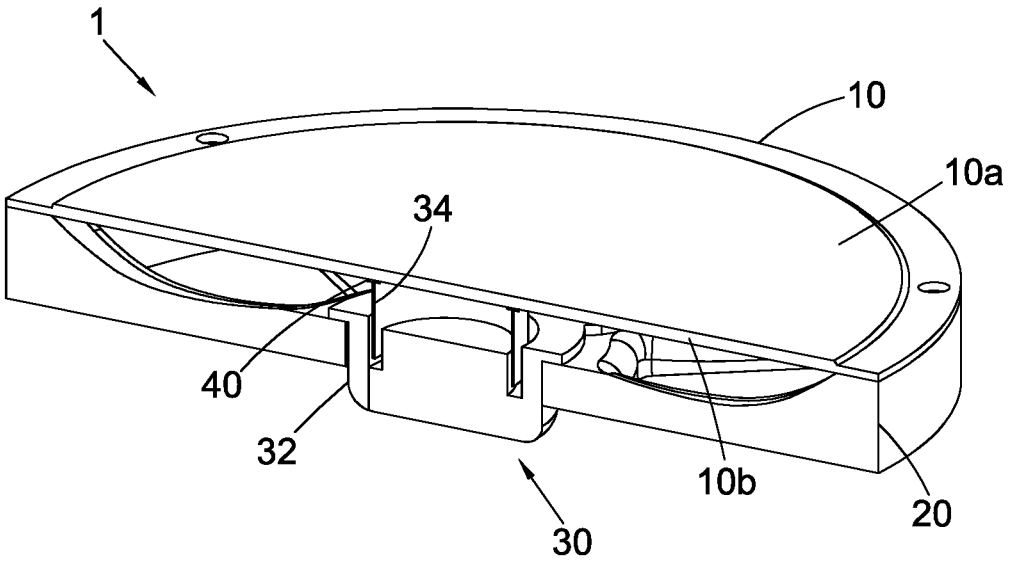
FIG. 5 is an illustration of a cross-section through the flat panel loudspeaker of FIGS. 3 and 4.

FIG. 5 is an illustration of a cross-section through the flat panel loudspeaker of FIGS. 3 and 4. As can be seen, the support frame 20 has the rear surface 10*b* of the resonant panel 10 fixed thereto around substantially the whole of the outer boundary of the resonant panel 10. In this example, a first part 32 of the exciter 30 is mounted to the support frame 20. A second part 34 of the exciter 30 is coupled to the rear surface 10*b* of the resonant panel 10. In this example, the second part 34 of the exciter is coupled to the rear surface 10*b* of the resonant panel 10 via a foot 40. Thus, when the resonant panel 10 is caused by the exciter 30 to vibrate on operation of the exciter 30, the outer boundary region 12 of the resonant panel 10 remains fixed to the support frame 20 and substantially only the inner region of the resonant panel 10 vibrates relative to the support frame 20. In other words, the outer boundary region 12 of the resonant panel 10 is fixed relative to the mounting surface. This ensures that the plaster or other surface covering of the mounting surface is not damaged by operation of the flat panel loudspeaker 1. Although the description above described that the first part 32 of the exciter 30 is mounted to the support frame 20, it will be understood that in some examples, the exciter may be an inertial exciter. That is, the first part 32 of the exciter 30 may have sufficient inertial mass such that operation of the exciter 30 causes movement of the resonant panel 10 even when the first part 32 of the exciter 30 is not mounted to any support frame 20.

It will be understood that the rear surface 10*b* of the resonant panel 10 can be fixed to the support frame 20 in a variety of ways. For example, as shown in FIG. 3, the plurality of mounting holes 14 can be used to secure the outer boundary region 12 of the resonant panel 10 to the support frame 20. Alternatively or additionally, an adhesive fastening means can be used to fix the outer boundary region 12 of the rear surface 10*b* of the resonant panel 10 to the support frame 20. In examples, the adhesive may extend substantially around the whole of the outer boundary of the rear surface 10*b* of the resonant panel 10. In other examples, the adhesive may be provided in a plurality of distributed locations around the outer boundary of the rear surface 10*b* of the resonant panel 10.

The exciter 30 is located substantially at an axial centre of the resonant panel 10 such that a shortest distance from the second part 34 of the exciter 30 to the outer boundary of the resonant panel 10 is substantially the same anywhere around the second part 34 of the exciter 30 at the foot 40.

In this example, the first part 32 of the exciter 30 comprises an electromagnet which can be activated and de-activated by an input electronic signal. The second part 34 of the exciter 30 comprises a metal component, such as a coil, which can be attracted and/or repelled by the electromagnet of the first part 32 when the electromagnet is activated. Thus, the resonant panel can be caused to vibrate and produce sound in response to operation of the electromagnet of the first part 32 of the exciter 30 by the input electronic signal. The exciter 30 as described may be termed a moving coil exciter. It will be understood that the skilled person is aware of other exciters which can be used in flat panel loudspeakers, including methods for their construction and operation. Other examples of exciters include moving magnet exciters, magneto drivers, and piezo-electric exciters.

The foot 40 provides an interface between the second part 34 of the exciter 30 and the rear surface 10*b* of the resonant panel 10. In this example, the foot 40 is substantially cylindrical and provides a circular interface between the exciter 30 and the rear surface 10*b* of the resonant panel 10.

Figure 6:
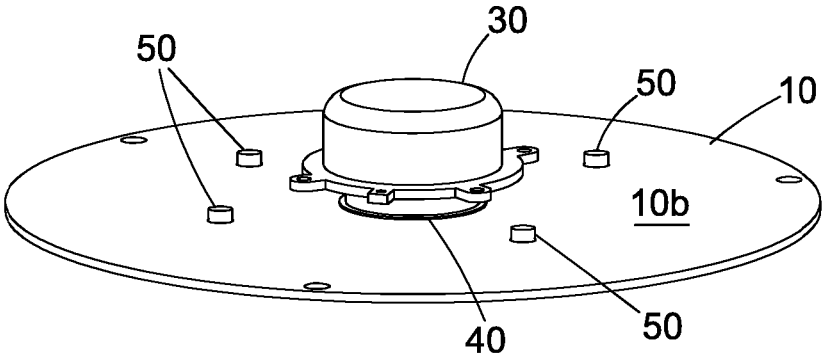
FIG. 6 is an illustration of an underside of the resonant panel of the flat panel loudspeaker of FIGS. 3 to 5.

FIG. 6 is an illustration of an underside of the resonant panel of the flat panel loudspeaker of FIGS. 3 to 5. As has been described with reference to previous figures, the rear surface 10*b* of the resonant panel 10 of the flat panel loudspeaker 1 is mounted to the exciter 30 via a foot 40 in contact with the rear surface 10*b* of the resonant panel. Owing to the circular geometry of the resonant panel 10 and the central mounting of the foot 40 and the exciter 30 on the resonant panel 10, the resonant panel 10 is provided with mode distribution means in the form of one or more components 50 coupled to the resonant panel 10 to add weight thereto. The one or more components 50 are arranged such that the resonant panel 10 in combination with the one or more components 50 is non-circularly symmetric. In other words, the natural modes of oscillation of the resonant panel in response to operation of the exciter in an assembly of the resonant panel, the support frame and the exciter, absent the mode distribution means are distorted. Thus, it has been found that significant notches and/or peaks in the frequency response of the flat panel loudspeaker, which would otherwise be present due to the circular shape of the resonant panel and central mounting of the exciter, can be lessened in intensity. In some examples, the notches and/or peaks can be substantially eliminated from the frequency response by careful positioning of the mode distribution means. Viewed in another way, audio energy from peaks in the frequency response for the flat panel loudspeaker in the absence of the mode distribution means can be redistributed to heavily damped areas of the frequency response.

In this example, the arrangement of the one or more components 50 is non-rotationally symmetric. In this example, the one or more components 50 are in the form of metal weights. In this example, the metal weights are formed from a non-toxic metal. Suitable non-toxic metals include stainless steel. In this example, the one or more components 50 are mounted on the rear surface 10*b* of the resonant panel 10.

Although the presently described example uses four metal weights 50 to provide the mode distribution means, it will be understood that the mode distribution means may be provided in any other suitable way. For example, the resonant panel 10 could be provided with one or more depressions defined in the front surface 10*a* thereof and arranged to be filled-in, for example with plaster, during installation of the flat panel loudspeaker 1 in the mounting surface. The one or more depressions could be arranged such that, when filled in, the natural modes of oscillation of the resonant panel in response to operation of the exciter in an assembly of the resonant panel, the support frame and the exciter, absent the mode distribution means are distorted.

Figure 7:
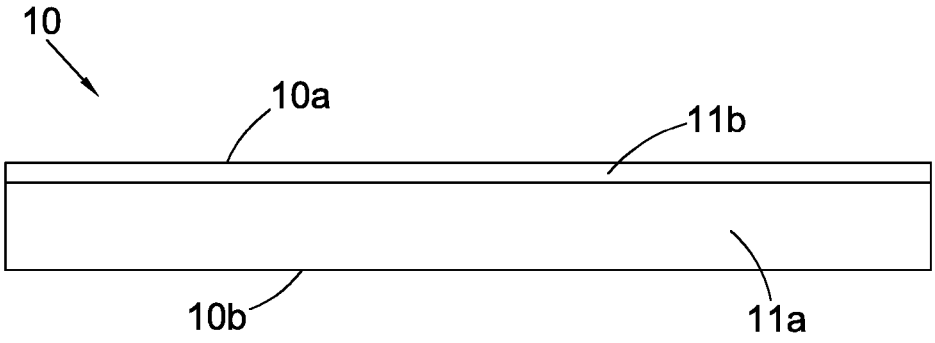
FIG. 7 is a schematic illustration of a resonant panel for use with the flat panel loudspeaker of FIGS. 3 to 5.

FIG. 7 is a schematic illustration of a resonant panel for use with the flat panel loudspeaker of FIGS. 3 to 5. The resonant panel 10 is formed from a plurality of layers 11*a*, 11*b*. The front surface 10*a* of the resonant panel 10 is provided by a skin layer 11*b* which is supported on a core layer 11*a*. In examples, the rear surface 10*b* of the resonant panel 10 is provided by a surface of the core layer 11*a*, opposite the skin layer 11*b*. In other examples (not shown), the rear surface 10*b* of the resonant panel 10 is provided by a further skin layer. The skin layer 11*b* is typically formed from fibre-based sheet, such a paper. The core layer 11*a* is typically formed from a matrix construction. In this example, the resonant panel 10 may be manufactured by pressing and curing an assembly of the core layer 11*a*, in a pre-preg condition, and the skin layer 11*b* at sufficient heat and pressure to cause the skin layer 11*b* to bond to the core layer 11*a*, resulting in a strong, lightweight, stiff resonant panel 10. The core layer 11*a* in this example is formed from a composite material.

Figure 8:
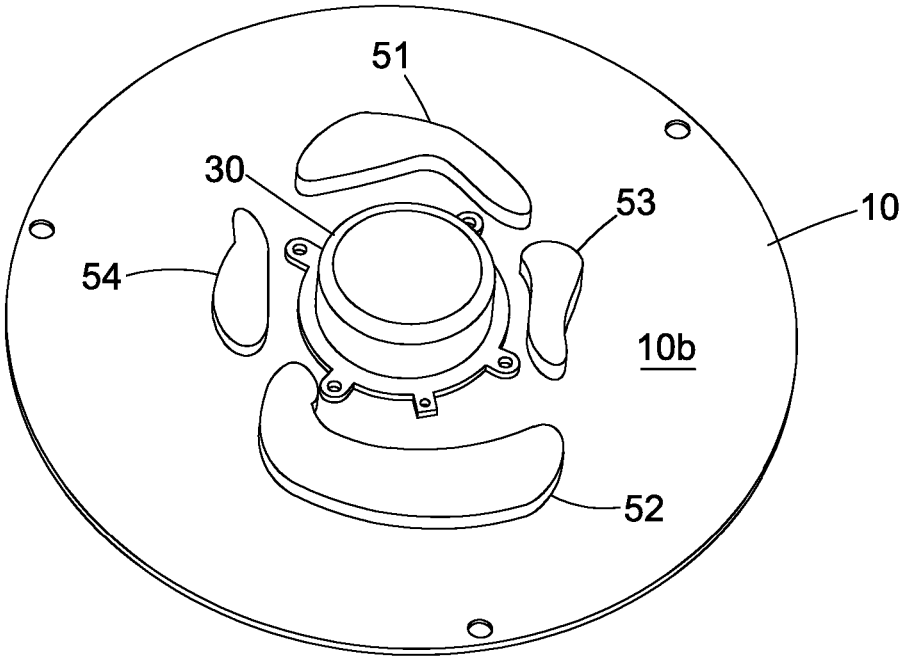
FIG. 8 is an illustration of an underside of a further example of a resonant panel for the flat panel loudspeaker shown in FIGS. 3 to 5.

FIG. 8 is an illustration of an underside of a further example of a resonant panel for the flat panel loudspeaker shown in FIGS. 3 to 5. The resonant panel 10 is substantially as described hereinbefore apart from the hereinafter noted differences. In particular, the mode distribution means is provided by a plurality of components 51, 52, 53, 54, at least one of which has a different size and shape to another of the plurality of components 51, 52, 53, 54. In this example, a first component 51 is positioned substantially opposite a second component 52, though the first component 51 has a depth greater than the second component 52 and the first component 51 is a different size and shape to the second component 52. A third component 53 is positioned on the rear surface 10*b* of the resonant panel 10, rotationally spaced from the first component 51 and the second component 52. A fourth component 54 is positioned substantially opposite the third component 53. The fourth component 54 has a depth less than the third component 53. The fourth component 54 has a size and shape different from the third component 53. Further, the first, second, third and fourth components 51, 52, 53, 54 are specifically positioned to distort the natural modes of oscillation of the resonant panel 10, substantially as described hereinbefore.

In summary, there is provided a flat panel loudspeaker (1) for mounting in a mounting surface. The flat panel loudspeaker (1) comprises a resonant panel (10) insertable into a circular opening in the mounting surface and having a front surface (10*a*) having an outer boundary (12) formed to be substantially circular. The front surface (10*a*) faces outwardly in the mounting surface when the flat panel loudspeaker (1) is mounted in the mounting surface. The resonant panel (10) further comprises a rear surface (10*b*) opposite the front surface (10*a*). The flat panel loudspeaker (1) further comprises an exciter (30) located substantially at an axial centre of the circular resonant panel (10) and coupled to the rear surface (10*b*) of the resonant panel (10) to cause the resonant panel (10) to vibrate, on operation of the exciter (30), to generate sound. The flat panel loudspeaker (1) further comprises a support frame (20) for mounting in the mounting surface and having the rear surface (10*b*) of the resonant panel (10) fixed thereto around substantially the whole of the outer boundary (12) of the resonant panel (10), such that when mounted in the mounting surface and when the resonant panel (10) is caused by the exciter (30) to vibrate on operation of the exciter (30), the outer boundary (12) of the resonant panel (10) is fixed relative to the mounting surface. The flat panel loudspeaker (1) further comprises mode distribution means (50) configured to induce, in use, non-circularly symmetric distortion of natural modes of oscillation of the resonant panel (10) in response to operation of the exciter (30) in an assembly of the resonant panel (10), the support frame (20) and the exciter (30) absent the mode distribution means (50).

Throughout the description and claims of this specification, the words "comprise" and "contain" and variations of them mean "including but not limited to", and they are not intended to (and do not) exclude other components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The invention claimed is:

1. A flat panel loudspeaker adapted to be mounted in a mounting surface, comprising:

a resonant panel insertable into a circular opening in the mounting surface and including opposing front and rear surfaces, wherein the front surface has a substantially circular outer boundary and faces outwardly when the flat panel loudspeaker is mounted in the mounting surface;

an exciter coupled to the rear surface of the resonant panel substantially at an axial center of the resonant panel and operable to cause the resonant panel to vibrate to generate sound;

a support frame for mounting in the mounting surface, wherein the rear surface of the resonant panel is coupled to the support frame around substantially the outer boundary of the resonant panel, and wherein when mounted in the mounting surface and when the resonant panel is caused by the exciter to vibrate, the outer boundary of the resonant panel is fixed relative to the mounting surface; and a component coupled to the resonant panel near the exciter, proximal to the axial center of the resonant panel, to add weight to the resonant panel to induce non-circularly symmetric distortion of natural modes of oscillation of the resonant panel in response to operation of the exciter in an assembly of the resonant panel, the support frame, and the exciter that occur absent the component.

2. The flat panel loudspeaker as claimed in claim 1, wherein the component is configured to induce non-rotationally symmetric distortion of natural modes of oscillation of the resonant panel in response to operation of the exciter in the assembly of the resonant panel, the support frame and the exciter absent the component.

3. The flat panel loudspeaker as claimed in claim 1, wherein the one or more components are formed from non-toxic metal.

4. The flat panel loudspeaker as claimed in claim 1, wherein the one or more components are coupled to the resonant panel away from the center of the resonant panel in a direction along the rear surface of the resonant panel.

5. The flat panel loudspeaker as claimed in claim 4, wherein the component includes at least two components, and wherein each of the at least two components is differently spaced from the center of the resonant panel.

6. The flat panel loudspeaker as claimed in claim 5, wherein the at least two components are spaced apart over a region of at least 60 degrees relative to the center of the resonant panel.

7. The flat panel loudspeaker as claimed in claim 5, wherein the at least two components is at least four components, and wherein a maximum angular spacing between any two components of the at least four components, relative to the center of the resonant panel, is less than 180 degrees.

8. The flat panel loudspeaker as claimed in claim 1, wherein the one or more components are coupled to the rear surface of the resonant panel.

9. The flat panel loudspeaker as claimed in claim 1, wherein a center of mass of an assembly of the resonant panel and the component is away from a center of the resonant panel in a direction along the front surface of the resonant panel.

10. The flat panel loudspeaker as claimed in claim 1, wherein the exciter is coupled to the rear surface of the resonant panel via a foot, and wherein the component is provided at one or more regions of the resonant panel outside the foot.

11. The flat panel loudspeaker as claimed in claim 1, wherein the component is arranged to be asymmetric relative to any line of symmetry through the center of the resonant panel.

12. The flat panel loudspeaker as claimed in claim 1, wherein the resonant panel includes at least one selected from among:

an outer diameter of less than about 30 centimeters (11.81 inches), and a maximum thickness of the resonant panel is less than about 3 millimeters (0.118 inches).

13. The flat panel loudspeaker as claimed in claim 1, wherein the resonant panel has a substantially constant density per unit area across the front surface of the resonant panel.

14. The flat panel loudspeaker as claimed in claim 1, wherein the resonant panel has a stiffness that is sufficient to cause at least one selected from among:

sound having a high frequency over 10 kHz to be emitted from the resonant panel when the exciter is operated at substantially the high frequency, and sound having a low frequency below 100 Hz to be emitted from the resonant panel when the exciter is operated at substantially the low frequency.

15. The flat panel loudspeaker as claimed in claim 1, wherein the resonant panel includes an inner region and a boundary region surrounding the inner region and extending to the outer boundary of the resonant panel, and wherein the front surface of the resonant panel in the boundary region is defined by a depression relative to at least a portion of the front surface of the resonant panel in the inner region.

16. The flat panel loudspeaker as claimed in claim 1, wherein the resonant panel is a pressed panel.

17. A method of mounting a flat panel loudspeaker in a mounting surface, the flat panel loudspeaker including a resonant panel insertable into a circular opening in the mounting surface and having opposing front and rear surfaces, wherein the front surface has a substantially circular outer boundary and faces outwardly when the flat panel loudspeaker is mounted in the mounting surface, and the resonant panel further having a rear surface opposite the front surface, an exciter coupled to the rear surface of the resonant panel substantially at an axial center of the resonant panel and operable to cause the resonant panel to vibrate to generate sound, a support frame for mounting in the mounting surface, wherein the rear surface of the resonant panel is coupled to the support frame around substantially the whole of the outer boundary of the resonant panel, and wherein when mounted in the mounting surface and when the resonant panel is caused by the exciter to vibrate, the outer boundary of the resonant panel is fixed relative to the mounting surface, and a component coupled to the resonant panel near the exciter, proximal to the axial center of the resonant panel, to add weight to the resonant panel to induce non-circularly symmetric distortion of natural modes of oscillation of the resonant panel in response to operation of the exciter in an assembly of the resonant panel, the support frame and the exciter that occur absent the component, the method comprising:

forming a circular opening in the mounting surface having a diameter greater than a diameter of the outer boundary of the resonant panel;

inserting the flat panel loudspeaker in the circular opening; and securing the support frame at the mounting surface, wherein the front surface of the resonant panel faces outwardly and is substantially flush to the mounting surface.

18. The method as claimed in claim 17, after the step of securing the support frame at the mounting surface further comprising applying a covering to the mounting surface, wherein the covering extends over at least an interface between the mounting surface and the resonant panel.

19. The method as claimed in claim 18, wherein the covering is plaster.

20. The flat panel loudspeaker as claimed in claim 1, wherein the resonant panel includes a skin layer composed of a fibre-based material and a core layer formed from a matrix construction.

* * * * *